US007756432B2

(12) United States Patent
Mase

(10) Patent No.: US 7,756,432 B2
(45) Date of Patent: Jul. 13, 2010

(54) IMAGE FORMING APPARATUS AND CARTRIDGE HAVING OPTICAL DETECTION OF TONER AMOUNT

(75) Inventor: Soichiro Mase, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 478 days.

(21) Appl. No.: 11/854,161

(22) Filed: Sep. 12, 2007

(65) Prior Publication Data

US 2008/0080899 A1 Apr. 3, 2008

(30) Foreign Application Priority Data

Sep. 28, 2006 (JP) ..... 2006-264688

(51) Int. Cl.
*G03G 15/08* (2006.01)
*G03G 15/10* (2006.01)

(52) U.S. Cl. ..... 399/64; 399/263

(58) Field of Classification Search ..... 399/27, 399/30, 58, 62, 64, 254, 263
See application file for complete search history.

(56) References Cited

U.S. PATENT DOCUMENTS 5,655,175 A * 8/1997 Oshida ..... 399/27
6,337,956 B1 * 1/2002 Sato et al. ..... 399/27
6,501,933 B2 * 12/2002 Ishii ..... 399/254
6,553,189 B2 * 4/2003 Miyamoto et al. ..... 399/27
6,859,629 B2 * 2/2005 Miura et al. ..... 399/64
7,072,594 B2 * 7/2006 Hoshi et al. ..... 399/27
7,529,492 B2 * 5/2009 Takahashi ..... 399/27

FOREIGN PATENT DOCUMENTS

JP 6019310 1/1994
JP 08248759 A * 9/1996
JP 10260578 A * 9/1998
JP 11194602 A * 7/1999
JP 11338240 A * 12/1999
JP 2000250298 9/2000
JP 2000347494 A * 12/2000
JP 2001005276 A * 1/2001
JP 2002268360 A * 9/2002
JP 2004117866 A * 4/2004
JP 2004191559 7/2004
JP 2004191862 A * 7/2004
JP 2006106056 A * 4/2006

* cited by examiner

*Primary Examiner*—Robert Beatty
(74) *Attorney, Agent, or Firm*—Banner & Witcoff, Ltd.

(57) ABSTRACT

An image forming apparatus is described. The image forming apparatus includes a first casing accommodating a developing agent and having a first opening, an agitating member rotatably provided in the first casing and agitating the developing agent, a detection device outputting a signal in response to receiving of detection light passing through the first casing, and a control unit detecting an amount of the developing agent accommodated in the first casing and the position of the agitating member on the basis of the signal output from the detection device.

14 Claims, 6 Drawing Sheets

IMAGE FORMING APPARATUS AND CARTRIDGE HAVING OPTICAL DETECTION OF TONER AMOUNT

CROSS REFERENCE TO RELATED APPLICATION

This application claims priority to Japanese Patent Application No. 2006-264688 filed on Sep. 28, 2006, the disclosure of which is herein incorporated into the present application.

TECHNICAL FIELD

The present invention relates to an image forming apparatus and a cartridge provided therein.

BACKGROUND

In an image forming apparatus such as a laser printer, an electrostatic latent image is formed on the surface of a photosensitive drum. The electrostatic latent image is developed by a toner, so that a toner image is carried on the surface of the photosensitive drum. The toner image is transferred to a sheet, thereby achieving image formation on the sheet. Such an image forming apparatus includes a developing apparatus for feeding a toner to the photosensitive drum.

The developing apparatus includes a developing tank accommodating a developing roller, and a toner cartridge set on the upper portion of the developing tank for supplying the toner into the developing tank, for example. The toner cartridge is provided with an agitating member for agitating the toner. The toner accommodated in the toner cartridge is agitated by rotation of the agitating member, and fed into the developing tank from the toner cartridge.

In order to prevent the agitating member from continuously stopping while resistance is applied by the toner in this type of developing apparatus, proposed is a technique of detecting the position of the agitating member with a reflection- or transmission-type photosensor and stopping the agitating member on a position where the toner applies a less load to the agitating member.

If a sensor for detecting the position of the agitating member is independently provided, however, the number of components is increased as compared with the conventional developing apparatus, to disadvantageously increase the cost for and the size of the developing apparatus.

SUMMARY

One aspect of the present invention is to provide an image forming apparatus and a cartridge provided therein, capable of detecting the position of an agitating member without increasing the number of components.

The same or different aspect of the present invention may provide an image forming apparatus including: a first casing accommodating a developing agent and having a first opening; an agitating member rotatably provided in the first casing for agitating the developing agent; a detection device outputting a signal in response to receiving of detection light passing through the first casing; and a control unit detecting an amount of the developing agent accommodated in the first casing and a position of the agitating member on the basis of the signal output from the detection device.

One or more aspects of the present invention may provide a cartridge including: a first casing having a wall portion and accommodating a developing agent; a first light passing portion formed in the wall portion for allowing passage of detection light passing through the first casing; and an agitating member for agitating the developing agent accommodated in the first casing, wherein the agitating member comprises a rotating shaft rotatably supported on the wall portion, an agitating blade supported by the rotating shaft, a light shielding member supported by the rotating shaft, and a second light passing portion provided on the light shielding member for allowing passage of the detection light.

DETAILED DESCRIPTION

Embodiments of the present invention are now described with reference to the drawings.

First Embodiment

1. General Structure of Laser Printer

Figure 1:
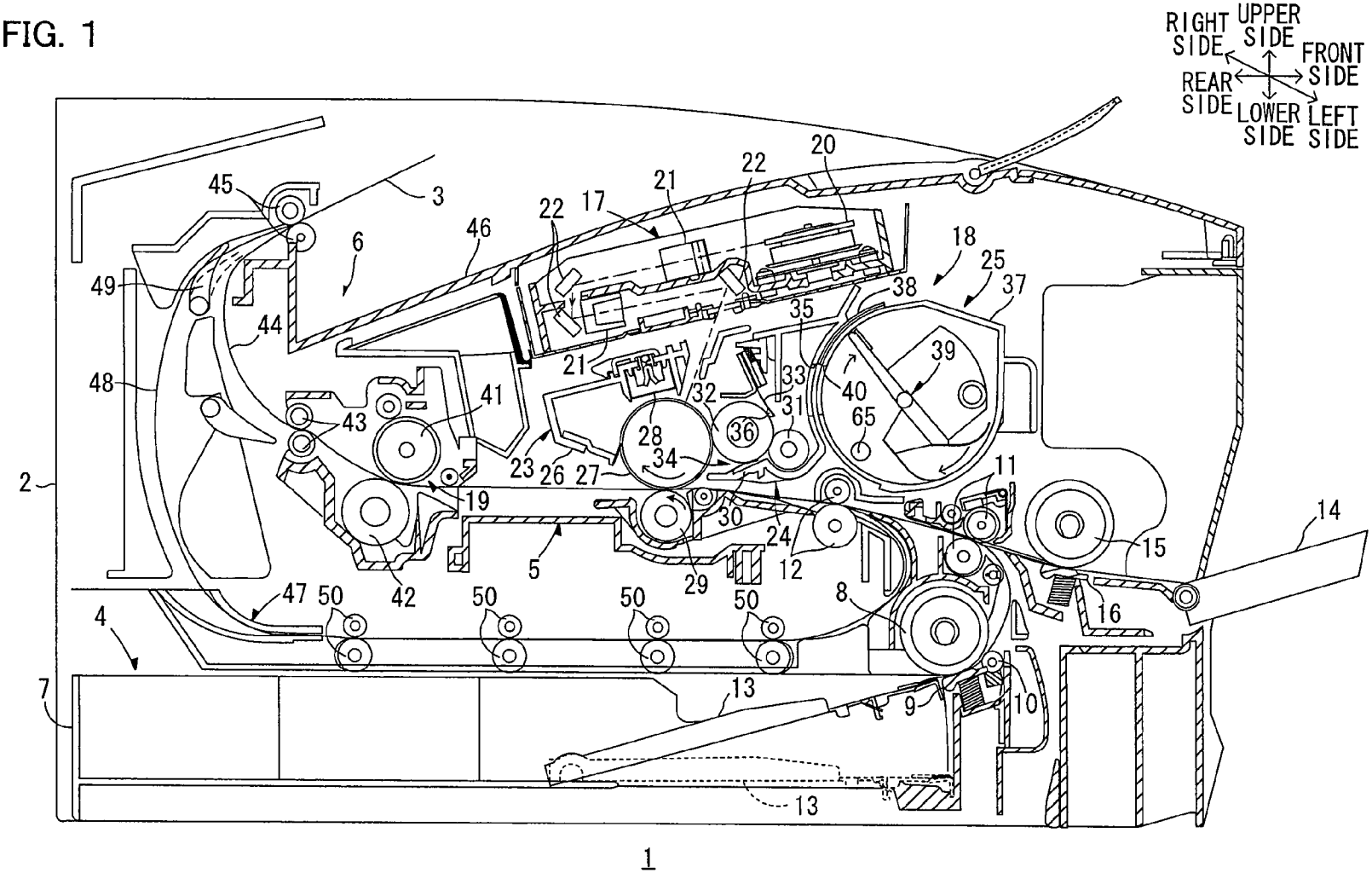
FIG. 1 is a partial side sectional view showing an embodiment of a laser printer as an example of an image forming apparatus according to the present invention.

FIG. 1 is a partial side sectional view showing an embodiment of a laser printer as an example of an image forming apparatus according to the present invention.

This laser printer 1 includes a sheet feeding section 4 for feeding a sheet 3, an image forming section 5 for forming an image on the fed sheet 3 and a sheet ejecting section 6 for ejecting the sheet 3 subjected to image formation on the image forming section 5 in a main body casing 2.

In the following description, it is assumed that the side of the laser printer 1 provided with a sheet feeding roller 8 described later is the "front side" and the side provided with sheet ejecting rollers 45 described later is the "rear side", while this side and the other side of FIG. 1 along the thickness thereof are the "left side" and the "right side" respectively.

A processing unit 18 described later is also described with reference to these directions.

1-1. Sheet Feeding Section

The sheet feeding section 4 includes a sheet feeding tray 7 detachably mounted on the bottom portion of the main body casing 2 along the anteroposterior direction, the sheet feeding roller 8 and a sheet feeding pad 9 provided above the front end portion of the sheet feeding tray 7, sheet dust removing rollers 10 and 11 provided in front of and above the sheet feeding roller 8 respectively and registration rollers 12 provided at the back of the sheet dust removing rollers 11.

The sheet feeding tray 7 is provided with a sheet pressing plate 13 on which sheets 3 are stacked. The uppermost sheet 3 located on the sheet pressing plate 13 is pressed against the sheet feeding roller 8 by a spring (not shown) from the rear side of the sheet pressing plate 13. When the sheet feeding roller 8 is rotated, the uppermost sheet 3 is sandwiched between the sheet feeding roller 8 and the sheet feeding pad 9, and thereafter fed. The fed sheet 3 is subjected to removal of sheet dust by the sheet dust removing rollers 10 and 11, and thereafter transported to the registration rollers 12. The registration rollers 12 include a pair of rollers, and transfer the sheet 3 to a transfer position (described later) of the image forming section 5 after registering the same.

The sheet feeding section 4 includes a multi purpose tray 14, a multi-purpose-side sheet feeding roller 15 and a multi-purpose-side sheet feeding pad 16 for manual sheet feeding.

1-2. Image Forming Section

The image forming section 5 includes a scanning unit 17, the processing unit 18 and a fixing section 19.

1-2-1. Scanning Unit

The scanning unit 17 is provided in an upper portion of the main body casing 2. The scanning unit 17 includes a laser (not shown), a rotationally driven polygonal mirror 20, a plurality of lenses 21 and a plurality of reflecting mirrors 22. A laser beam emitted from the laser on the basis of image data is reflected by the polygonal mirror 20, passes through and is reflected by the plurality of lenses 21 and the plurality of reflecting mirrors 22 respectively, and is irradiated onto the surface of a photosensitive drum 27 of the processing unit 18, as shown by a chain line.

1-2-2. Processing Unit

The processing unit 18 is detachably mounted on the main body casing 2 under the scanning unit 17 in the main body casing 2.

The processing unit 18 integrally includes a drum section 23 forming the rear half portion thereof and a developing section 24 forming the front half portion thereof. The processing unit 18 further includes a toner hopper 25 detachably mounted on a later-described developer frame 30 of the developing section 24 as an example of cartridge.

1-2-2-1. Drum Section

The drum section 23 includes a drum frame 26, the photosensitive drum 27, a charger 28 and a transfer roller 29. The photosensitive drum 27, the charger 28 and the transfer roller 29 are supported by the drum frame 26.

The photosensitive drum 27 is opposed to a developing roller 32 described later, at the back of this developing roller 32. The photosensitive drum 27 is rotatable along an arrow shown in FIG. 1 (clockwise in FIG. 1). The photosensitive drum 27 is grounded, and the outermost layer thereof is formed by a positively chargeable photosensitive layer.

The charger 28 is provided above the photosensitive drum 27 in a spaced relation with the photosensitive drum 27. This charger 28 is a scorotron charger for positive charging which generates corona discharge from a wire of tungsten or the like. The surface of the photosensitive drum 27 is uniformly positively charged due to the corona discharge from the charger 28.

The transfer roller 29 is opposed to the photosensitive drum 27 under the photosensitive drum 27. The transfer roller 29 is rotatable along an arrow shown in FIG. 1. A transferring bias is applied to the transfer roller 29 in image formation.

1-2-2-2. Developing Section

The developing section 24 includes the developer frame 30 as an example of a second casing, a feed roller 31, the developing roller 32 as an example of a developing agent carrier, and a layer-thickness regulating blade 33.

The developer frame 30 is in the form of a box having a release port 34 extending in the width direction (right-and-left direction) on the rear end portion thereof. A developer-side communication port 35 as an example of a second opening communicating with a hopper-side communication port 40 (described later) of the toner hopper 25 is formed on the front wall of the developer frame 30 correspondingly to the shape of the hopper-side communication port 40. The feed roller 31, the developing roller 32 and the layer-thickness regulating blade 33 are provided in this developer frame 30.

The feed roller 31 is arranged obliquely under the rear side of the developer-side communication port 35. This feed roller 31 is formed by covering a roller shaft of a metal with a conductive foamed material. The roller shaft of the feed roller 31 is rotatably supported on both width-directional side walls of the developer frame 30. In image formation, the feed roller 31 is rotated by driving force from a motor (not shown) provided in the main body casing 2.

The developing roller 32 is arranged at the back of the feed roller 31. The developing roller 32 is in contact with the feed roller 31. Further, the developing roller 32 is in contact with the photosensitive drum 27 obliquely from above the front side thereof. This developing roller 32 is formed by covering a roller shaft of a metal with a conductive rubber material. The roller shaft of the developing roller 32 is rotatably supported on both width-directional side walls of the developer frame 30. In image formation, the developing roller 32 is rotated by driving force from a motor (not shown) provided in the main body casing 2. A prescribed developing bias is supplied to the developing roller 32.

The layer-thickness regulating lade 33 comprises a leaf spring member of a metal. A pressuring portion 36 of insulating silicone rubber is provided on the distal end portion of the layer-thickness regulating blade 33. The proximal edge portion of this layer-thickness regulating blade 33 is fixed to the developer frame 30 above the developing roller 32. The pressuring portion 36 is brought into pressure contact with the developing roller 32 obliquely from above the front side thereof, due to the elastic force of the leaf spring member.

1-2-2-3. Toner Hopper

The toner hopper 25 includes a generally cylindrical hopper frame 37 extending in the width direction, an opening/closing cover 38 as an example of a shutter member attached to this hopper frame 37, and an agitator 39 as an example of an agitating member provided in the hopper frame 37.

The hopper frame 37 accommodates a positively chargeable nonmagnetic single-component toner as a developing agent. The hopper-side communication port 40 as an example of a first opening is formed in the hopper frame 37. This hopper-side communication port 40 is opposed to the developer-side communication port 35, in a state where the toner hopper 25 is attached to the developer frame 30 of the developing section 24.

The opening/closing cover 38 is capable of opening/closing the hopper-side communication port 40.

The structures of the respective portions of the toner hopper 25 are described later in detail.

1-2-2-4. Operation of Processing Unit

The toner accommodated in the toner hopper 25 is agitated due to rotation of the agitator 39 along an arrow shown in FIG. 1, and fed into the developer frame 30 of the developing section 24 through the hopper-side communication port 40 and the developer-side communication pot 35 in an open state of the hopper-side communication port 40.

The toner transported into the developer frame 30 is fed to the developing roller 32 due to rotation of the feed roller 31. At this time, the toner is positively triboelectrically charged between the feed roller 31 and the developing roller 32. Then, the toner fed to the developing roller 32 enters into the space between the pressuring portion 36 of the layer-thickness regulating blade 33 and the developing roller 32, following rotation of the developing roller 32. Thus, the toner is regulated in layer thickness between the pressuring portion 36 and the developing roller 32, and carried on the surface of the developing roller 32 as a thin layer.

On the other hand, the surface of the photosensitive drum 27 is uniformly positively charged by the charger 28 following rotation of the photosensitive drum 27. Thereafter the surface of the photosensitive drum 27 is exposed by high-speed scanning with the laser beam from the scanning unit 17. Thus, an electrostatic latent image is formed on the surface of the photosensitive drum 27 on the basis of the image data.

Due to the rotation of the developing roller 32, the toner carried on the surface of the developing roller 32 is fed to the electrostatic latent image formed on the surface of the photosensitive drum 27, when the toner comes into contact with the photosensitive drum 27. In other words, the toner is fed to an exposed portion, exposed by the laser beam and reduced in potential, of the uniformly positively charged surface of the photosensitive drum 27. Consequently, the electrostatic latent image is visualized by the toner, and a toner image is carried on the surface of the photosensitive drum 27.

While each sheet 3 transported from the registration rollers 12 passes through the space (transfer position) between the photosensitive drum 27 and the transfer roller 29, the toner image is transferred to the sheet 3.

1-2-3. Fixing Section

The fixing section 19 is provided at the back of the processing unit 18. The fixing section 19 includes a heating roller 41, a pressure roller 42 brought into pressure contact with the heating roller 41 from below, and a pair of transport rollers 43 arranged at the back of the heating roller 41 and the pressure roller 42.

In the fixing section 19, the toner transferred to the sheet 3 on the transfer position is thermally fixed while the sheet 3 passes through the space between the heating roller 41 and the pressure roller 42. Thereafter the sheet 3 is transported to the sheet ejecting section 6 by the pair of transport rollers 43.

1-3. Sheet Ejecting Section

The sheet ejecting section 6 includes a sheet ejecting path 44 extending upward from the fixing section 19 so as to be reversed, the sheet ejecting rollers 45 provided on the downstream-side end portion of the sheet ejecting path 44, and a sheet ejection tray 46 formed on the upper surface of the main body casing 2 for receiving the sheet 3 ejected from the sheet ejecting roller 45.

The sheet 3 transported from the fixing section 19 to the sheet ejecting path 44 is transported from the sheet ejecting path 44 to the sheet ejecting roller 45, and ejected onto the sheet ejection tray 46 by the sheet ejecting rollers 45.

1-4. Reversal Transport Section

The laser printer 1 is provided with a reversal transport section 47 for forming images on both surfaces of the sheet 3. This reversal transport section 47 includes a reversal transport path 48, a flapper 49, and a plurality of reversal transport rollers 50.

When images are formed on both surfaces of the sheet 3, the ejected sheet 3 is first sandwiched by the sheet ejecting rollers 45 and reversedly transported toward the flapper 49. At this time, the flapper 49 switches the transport direction for the sheet 3 so that the sheet 3 is transported to the reversal transport path 48. The sheet 3 is reversedly transported to the reversal transport path 48, and thereafter transported to the reversal transport rollers 50. Then, the sheet 3 is reversed upward from the reversal transport rollers 50, and thereafter transported to the registration roller 12. The sheet 3 transported to the registration roller 12 is registered again in a turned-over state, and thereafter transported toward the transfer position of the image forming section 5. Thus, the images are formed on the both surfaces of the sheet 3.

2. Structure of Toner Hopper

Figure 2:
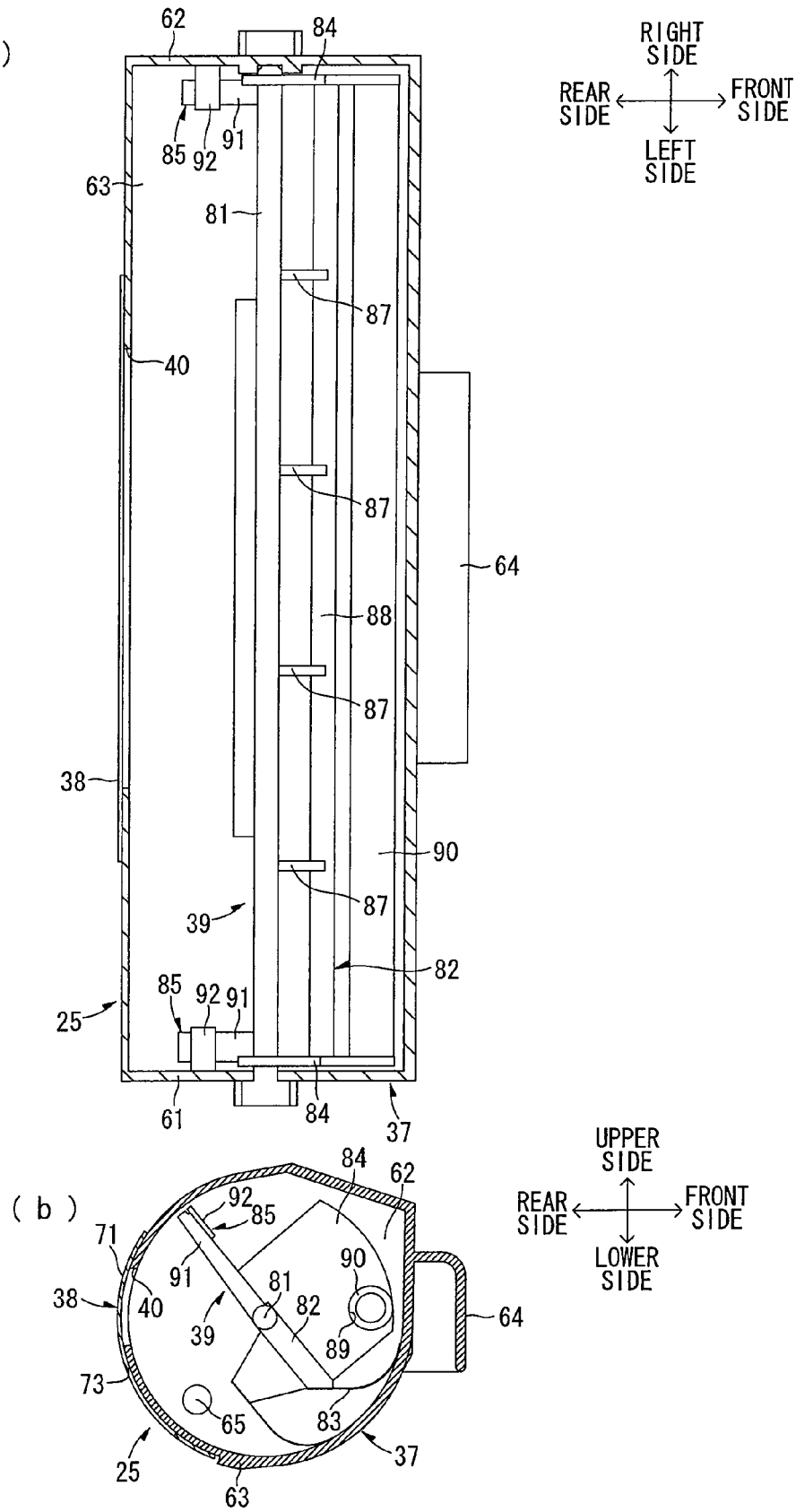
FIG. 2(*a*) is a plane sectional view of a toner hopper shown in FIG. 1, and FIG. 2(*b*) is a side sectional view thereof.
Figure 3:
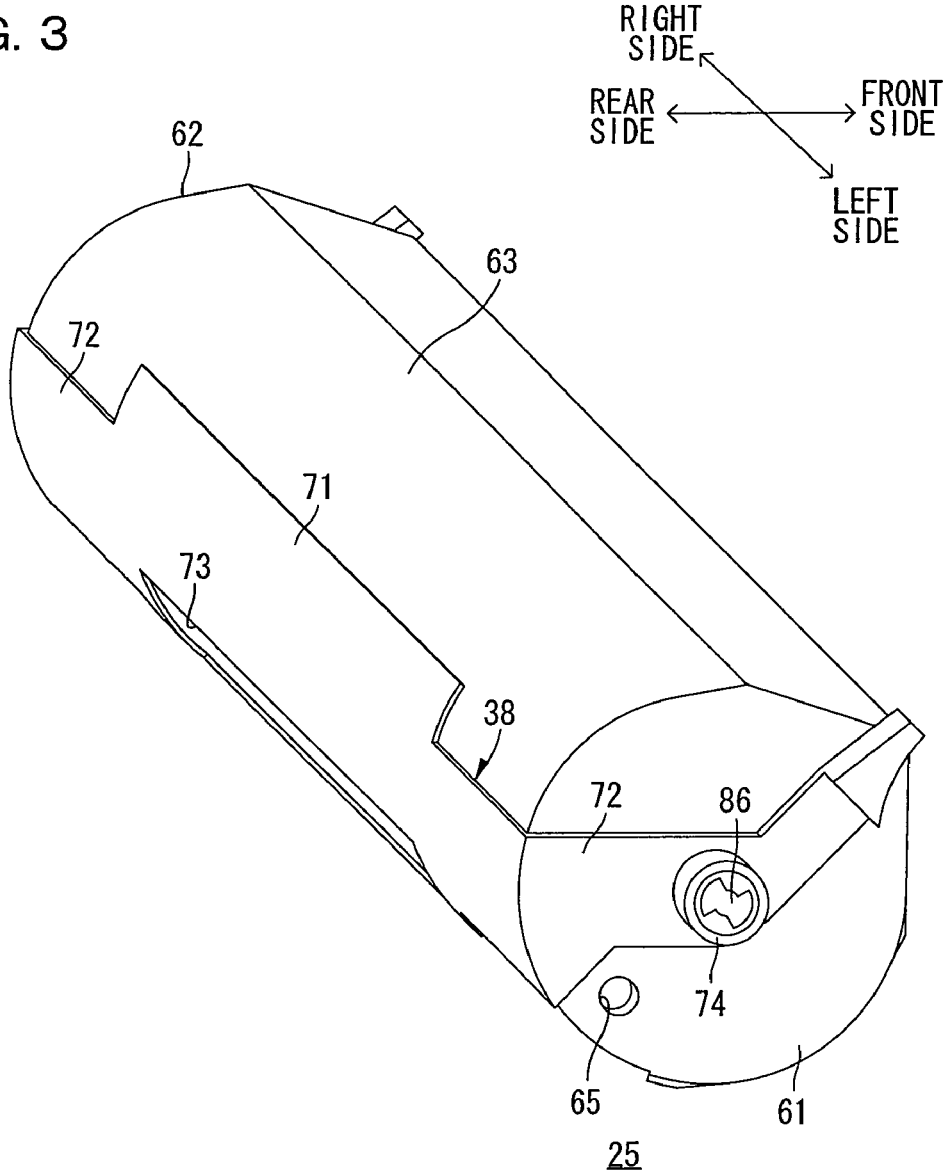
FIG. 3 is a perspective view of the toner hopper shown in FIG. 1, illustrating a state where an opening/closing cover closes a hopper-side communication port.
Figure 4:
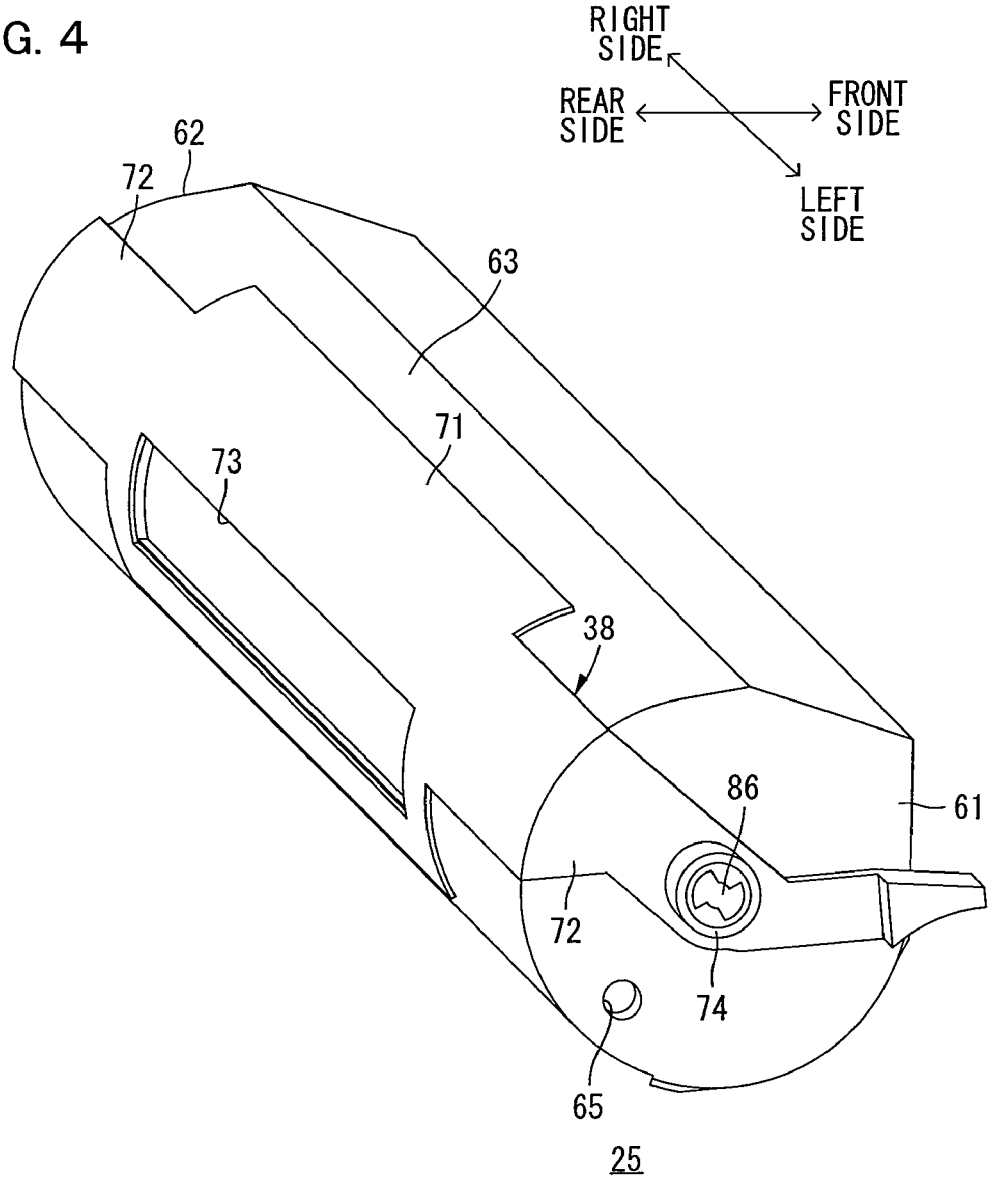
FIG. 4 is a perspective view of the toner hopper shown in FIG. 1, illustrating a state where the opening/closing cover opens the hopper-side communication port.

FIG. 2(*a*) is a plane sectional view of the toner hopper 25, and FIG. 2(*b*) is a side sectional view thereof. FIG. 3 is a perspective view of the toner hopper 25, showing a state where the opening/closing cover 38 closes the hopper-side communication port 40. FIG. 4 is a perspective view of the toner hopper 25, showing a state where the opening/closing cover 38 opens the hopper-side communication port 40.

The toner hopper 25 includes the hopper frame 37, the opening/closing cover 38 and the agitator 39, as hereinabove described.

2-1. Hopper Frame

The hopper frame 37 is generally in the form of a cylinder, and integrally includes a left side wall 61 as an example of a wall portion, a right side wall 62 as an example of the wall portion opposed to the left side wall 61 at an interval in the width direction, and a cylindrical circumferential side wall 63 extending between the left and right side walls 61 and 62.

The hopper-side communication pot 40 generally in the form of a long and thin rectangle is formed on the rear side of the circumferential side wall 63 along the width direction.

A grasp portion 64 for grasping the toner hopper 25 is formed on the front side of the circumferential side wall 63.

The left and right side walls 61 and 62 are provided with light passing windows 65 as examples of a first light passing portion on positions opposed to each other in the width direction respectively.

2-2. Opening/Closing Cover

The opening/closing cover 38 is provided for opening/closing the hopper-side communication port 40, as shown in FIGS. 3 and 4. This opening/closing cover 38 integrally includes a cover portion 71 and arm portions 72.

The cover portion 71 is in the form of an arc in side elevational view and a long and thin rectangle in rear elevational view along the surface of the circumferential side wall 63. The cover portion 71 is provided with a cover opening 73 generally in the form of a long and thin rectangle corresponding to the shape of the hopper-side communication port 40 provided in the hopper frame 37.

The arm portions 72 extend from both width-directional end portions of the cover portion 71 along the circumferential side wall 63, are bent on both edges of the circumferential side wall 63, and extend along the left and right side walls 61 and 62 respectively. The distal end portions of the arm portions 72 are rotatably supported on respective cylindrical support portions 74 swelling out from the centers of the left and right side walls 61 and 62 in side elevational view.

Thus, when the arm portions 72 rotate about the support portions 74, the opening/closing cover 38 is swung between a closing position (position shown in FIG. 3) where the cover portion 71 covers the hopper-side communication port 40 and an opening position (position shown in FIG. 4) where the cover opening 73 of the cover portion 71 is opposed to the hopper-side communication port 40 of the hopper frame 37, and opens this hopper-side communication port 40.

In general, the opening/closing cover 38 is located on the closing position in the state where the toner hopper 25 is detached from the developer frame 30 (see FIG. 1) of the developing section 24, and located on the opening position in the state where the toner hopper 25 is attached to the developer frame 30 (see FIG. 1).

2-3. Agitator

The agitator 39 is provided in the hopper frame 37. The agitator 39 includes a rotating shaft 81, a frame 82, an agitating blade 83, light shielding plates 84 as examples of a light shielding member, and cleaners 85 as examples of a cleaning member.

2-3-1. Rotating Shaft

The rotating shaft 81 is arranged along the width direction as shown in FIG. 2(*a*) in the middle (center) of the hopper frame 37 in side elevational view as shown in FIG. 2(*b*), and extends between the left and right side walls 61 and 62.

Both axial end portions of the rotating shaft 81 are rotatably supported on the left and right side walls 61 and 62 respectively.

An agitator coupling passive gear 86 arranged in the support portion 74 of the left side wall 61 is connected to the left end portion of the rotating shaft 81, as shown in FIGS. 3 and 4.

2-3-2. Frame

The frame 82 is provided integrally with the rotating shaft 81. This frame 82 includes support bars 87 extending from the rotating shaft 81 in one radial outward direction, and a connecting bar 88 arranged in a spaced relation with the rotating shaft 81 in the one radial outward direction to extend parallelly to the rotating shaft 81, as shown in FIG. 2(*a*).

The plurality of (e.g. four) support bars 87 are provided along the axial direction of the rotating shaft 81 at regular intervals from one another.

The forward ends of the support bars 87 are connected to the connecting bar 88. Thus, the rotating shaft 81, the support bars 87 and the connecting bar 88 form a laddery structure.

2-3-3. Agitating Blade

The agitating blade 83 is formed by a flexible film such as a resin film. The agitating blade 83 is generally in the form of a long and thin rectangle extending along the axial direction of the rotating shaft 81. The agitating blade 83 is so formed that the size in the radial direction of the rotating shaft 81 (direction of the radius of rotation of the agitator 39) is greater than the distance between the rotating shaft 81 and the hopper-side communication port 40, i.e., the internal radius of the hopper frame 37. As shown in FIG. 2(*b*), one end portion of the agitating blade 83 along the width direction is fixed to the connecting bar 88, while the other end portion opposite thereto is formed as a distal end portion to frictionally slide with the inner wall surface of the hopper frame 37.

2-3-4. Light Shielding Plate

The light shielding plates 84 are generally in the form of rectangular plates. The light shielding plates 84 are provided on the left and right end portions of the rotating shaft 81 respectively, to extend in the radial direction. The light shielding plates 84 are arranged on the upstream side in the rotational direction of the agitator 39 with respect to the agitating blade 83. Thus, the light shielding plates 84 rotate following rotation of the rotating shaft 81, to be opposed to the light passing windows 65 and shield detection light (described later) passing through the space between the left and right light passing windows 65 for a constant time after the agitating blade 83 passes a position opposed to the light passing windows 65.

The light shielding plates 84 are provided with circular light guiding member insertion holes 89 on positions opposed to each other in the width direction. A cylindrical light guiding member 90 as an example of a second light passing portion extends between the light shielding plates 84 as shown in FIG. 2(*a*), while both width-directional end portions thereof are inserted into the light guiding member insertion holes 89. This light guiding member 90 rotates together with the light shielding plates 84 following the rotation of the rotating shaft 81, to be opposed to the light passing windows 65 in the width direction in a constant cycle.

2-3-5. Cleaner

Each cleaner 85 includes a fixing plate 91 and a wiper 92 fixed to the fixing plate 91.

The fixing plates 91 are in the form of flat plates. These fixing plates 91 are provided on both axial end portions of the rotating shaft 81 respectively. The fixing plates 91 are formed integrally with the rotating shaft 81, and extend oppositely to the support bars 87 from the rotating shaft 81.

The wipers 92 are made of an elastic material such as rubber. These wipers 92 are generally in the form of rectangular plates. The wipers 92 are fixed to the respective fixing plates 91 so that the outer axial end portions thereof slightly swell out from the fixing plates 91.

The cleaners 85 rotate following the rotation of the rotating shaft 81, to frictionally slide with the respective light passing windows 65 and wipe the light passing windows 65. Thus, the toner adhering to the light passing windows 65 is brushed away.

The light shielding plates 84 are arranged on the downstream side in the rotational direction of the agitator 39 with respect to the respective cleaners 85.

3. Driving Mechanism for Feed Roller, Developing Roller and Agitator

Figure 5:
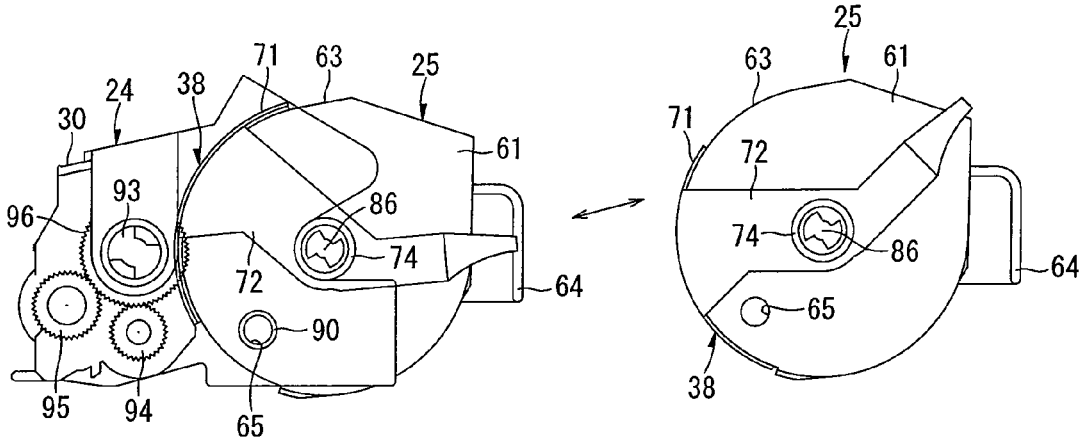
FIG. 5 is a left side elevational view of a developing section and the toner hopper shown in FIG. 1.

FIG. 5 is a left side elevational view of the developing section 24 and the toner hopper 25.

A developer coupling passive gear 93, a feed roller driving gear 94 connected to the roller shaft of the feed roller 31, a developing roller driving gear 95 connected to the roller shaft of the developing roller 32, and a transmission gear 96 meshing with the feed roller driving gear 94 and the developing roller driving gear 95 are arranged on the left side wall of the developer frame 30 of the developing section 24. The transmission gear 96 is integrally rotatable with the developer coupling passive gear 93.

As described above, the agitator coupling passive gear 86 is provided on the left side wall 61 of the hopper frame 37.

In the state where the processing unit 18 is mounted in the main body casing 2 (see FIG. 1), coupling shafts (not shown) provided in the main body casing 2 are connected to the developer coupling passive gear 93 and the agitator coupling passive gear 86 in a reciprocative and relatively unrotatable manner respectively, and driving force of a motor (not shown) provided in the main body casing 2 is independently input from the coupling shafts. Thus, the feed and developing rollers 31 and 32 and the agitator 39 are rotationally driven by the driving force of the motor provided in the main body casing 2 through driving systems independent of each other.

4. Control System for Agitator

Figure 6:
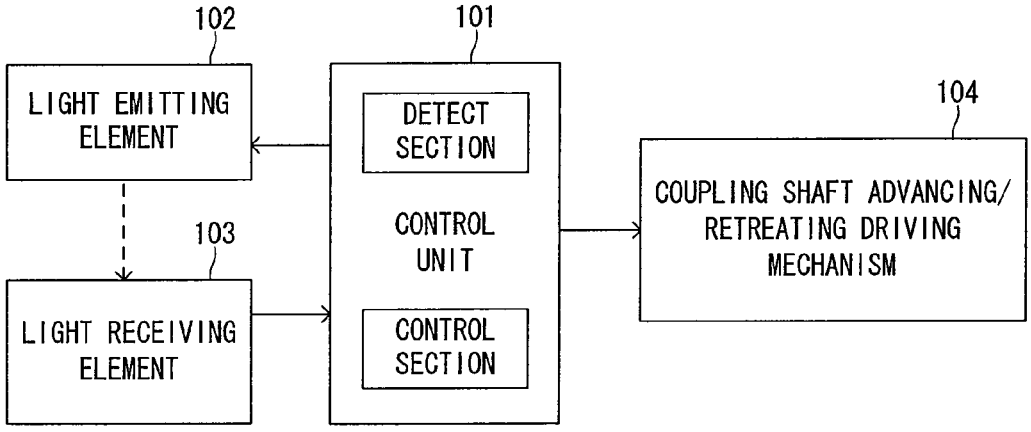
FIG. 6 is a block diagram showing a control system for an agitator shown in FIG. 2.

FIG. 6 is a block diagram showing a control system for the agitator 39.

The laser printer 1 includes a control unit 101 having a CPU, a RAM and a ROM.

In the main body casing 2 (see FIG. 1), a light emitting element 102 emitting the detection light is arranged on a position opposed to one light passing window 65 formed respectively in the left and right side walls 61 and 62 of the toner hopper 25 (hopper frame 37) from outside in the width direction, while a light receiving element 103 as an example of photodetection device arranged to receive the detection light emitted from the light emitting element 102 is arranged on a position opposed to the other light passing window 65 from outside in the width direction. A light emitting diode is used as the light emitting element 102. A phototransistor is used as the light receiving element 103. The light receiving element 103 outputs a high-level (HIGH) signal when not receiving the detection light, and outputs a low-level (LOW) signal when receiving the detection light.

The main body casing 2 further includes a coupling shaft advancing/retreating driving mechanism 104 for advancing/retreating the coupling shaft (not shown) connected to the agitator coupling passive gear 86.

The control unit 101 controls the light emission from the light emitting element 102, and controls the coupling shaft advancing/retreating driving mechanism 104 on the basis of the signal output from the light receiving element 103. Further, the control unit 101 detects the volume of the toner remaining in the toner hopper 25 on the basis of the signal output from the light receiving element 103.

5. Detection of Toner Volume and Control of Stop Position of Agitator

Figure 7:
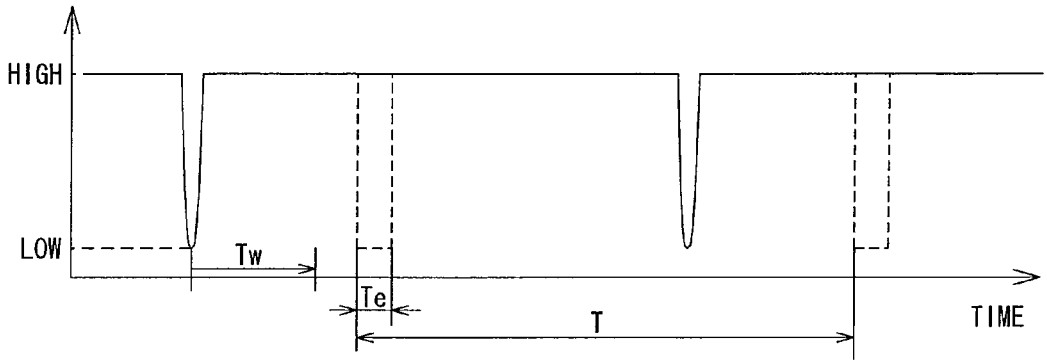
FIG. 7 is a timing chart for illustrating detection of the toner volume and control of a stop position of the agitator.
Figure 8:
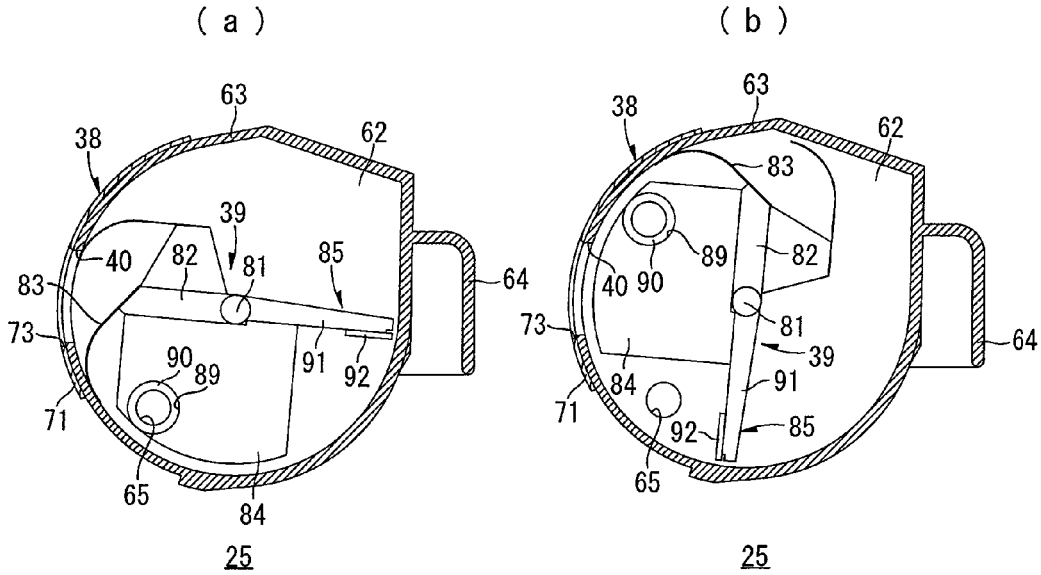
FIGS. 8(*a*) and 8(*b*) are side sectional views of the toner hopper, showing a state where a light guiding member is opposed to the corresponding light passing window and a state where the agitator is stopped respectively.

FIG. 7 is a timing chart for illustrating detection of the toner volume and control of a stop position of the agitator 39. FIGS. 8(*a*) and 8(*b*) are side sectional views of the toner hopper 25, showing a state where the light guiding member 90 is opposed to the corresponding light passing window 65 and a state where the agitator 39 is stopped respectively.

When the control unit 101 controls the coupling shaft advancing/retreating driving mechanism 104 and the coupling shaft (not shown) is connected to the agitator coupling passive gear 86, the driving force of the motor is transmitted to the agitator coupling passive gear 86. Due to this driving force, the rotating shaft 81 of the agitator 39 rotates at a constant speed (70 rpm, for example). Following this rotation of the rotating shaft 81, the agitating blade 83 of the agitator 39, the light shielding plates 84 and the cleaners 85 pass in this order positions (hereinafter simply referred to as a "position opposed to the light passing windows 65") width-directionally opposed to the light passing windows 65 formed respectively in the left and right side walls 61 and 62 of the toner hopper 25.

When passing the position opposite to the light passing windows 65, the agitating blade 83 presses the toner present in the vicinity of the light passing windows 65 toward the downstream side in the rotational direction of the rotating shaft 81 (agitating blade 83), so that no toner is present on the position opposed to the light passing windows 65. If a sufficient volume of toner is present in the toner hopper 25, the toner returns to the position opposed to the light passing windows 65 immediately after the agitating blade 83 passes the light passing windows 65, and blocks the detection light emitted from the light emitting element 102. This return of the toner to the position opposed to the light passing windows 65 is slowed down as the volume of the toner in the toner hopper 25 is reduced.

The toner accommodated in the toner hopper 25 remarkably fluctuates for a while after the agitating blade 83 passes the position opposed to the light passing windows 65, whereby the light receiving element 103 intermittently receives the detection light. In this toner hopper 25, therefore, the light shielding plates 84 are opposed to the respective light passing windows 65 after the agitating blade 83 passes the position opposed to the light passing windows 65. Even if no toner is present between the left and right light passing windows 65 for a constant time when the light shielding plates 84 are opposed to the light passing windows 65, the light shielding plate 84 blocks the detection light entering the toner hopper 25 from the one light passing window 65, and the light receiving element 103 outputs the high-level signal.

When the constant time elapses after the agitating blade 83 passes between the light passing windows 65, the light shielding plates 84 are unopposed to the light passing windows 65. If the toner has already returned to the position opposed to the light passing windows 65 at this point of time, the detection light is blocked by the toner, whereby the light receiving element 103 continuously outputs the high-level signal. If the light receiving element 103 regularly outputs the high-level signal during rotational driving of the agitator 39, therefore, it is determinable that the toner sufficiently remains in the toner hopper 25.

If the toner has not yet returned to the position opposed to the light passing windows 65 when the light shielding plates 84 are unopposed to the light passing windows 65, on the other hand, the detection light passes through the toner hopper 25. The light receiving element 103 receives this detection light, and outputs a low-level signal (empty signal), as shown by broken lines in FIG. 7. The light receiving element 103 continuously outputs this low-level signal until the toner returns to the position between the left and right light passing windows 65. Therefore, the length of a period Te when the light receiving element 103 outputs the low-level signal depends on the volume of the toner remaining in the toner hopper 25. Thus, the control unit 101 can detect the volume of the toner remaining in the toner hopper 25 on the basis of the period Te when the light receiving element 103 outputs the low-level signal. If the period Te when the light receiving element 103 outputs the low-level signal exceeds a predetermined time, it is determinable that the toner hopper 25 is in an empty state hardly accommodating the toner.

As hereinabove described, the light guiding member 90 is width-directionally opposed to the light passing windows 65 in the constant cycle, following the rotation of the rotating shaft 81. When the light guiding member 90 is opposed to the light passing windows 65, the detection light entering the toner hopper 25 from the one light passing window 65 can reach the other light passing window 65 through the light guiding member 90. The light receiving element 103 receives this detection light, and outputs the low-level signal. In other words, the light receiving element 103 pulsatively outputs the low-level signal at the timing when the light guiding member 90 is opposed to the light passing windows 65 as shown in FIG. 7, while the light shielding plates 84 are opposed to the light passing windows 65. At the timing when the low-level signal is output, the light guiding member 90 is opposed to the light passing windows 65, and the agitating blade 83 is located in the vicinity of the hopper-side communication port 40 (on a slightly upstream side from the hopper-side communication port 40 in the rotational direction of the rotating shaft 81) of the toner hopper 25 (hopper frame 37), as shown in FIG. 8(*a*).

Therefore, the control unit 101 can determine that the agitating blade 83 is located in the vicinity of the hopper-side communication port 40 of the toner hopper 25 (hopper frame 37) at the timing when the light receiving element 103 pulsatively outputs the low-level signal. In case of stopping the rotation of the agitator 39, the control unit 101 controls the coupling shaft advancing/retreating driving mechanism 104 when a prescribed time Tw elapses after the light receiving element 103 outputs the pulsative low-level signal, to retreate the coupling shaft (not shown) from the agitator coupling passive gear 86. Consequently, the agitator 39 is stopped on a position where the agitating blade 83 has passed the hopper-side communication port 40, as shown in FIG. 8(*b*). Thus, the agitating blade 83 can be prevented from interfering with the opening/closing cover 38 to be sandwiched between the opening/closing cover 38 and the hopper-side communication port 40 when the opening/closing cover 38 is closed.

The toner accommodated in the toner hopper 25 remarkably fluctuates immediately after the agitating blade 83 passes the position opposed to the light passing windows 65, whereby the light receiving element 103 intermittently receives the detection light. If the light receiving element 103 detects the detection light passing through the toner hopper 25 at this time, the volume of the toner is not correctly determined. The light shielding plates 84 are essential for preventing this. According to the present invention, the light shielding plates 84 are provided with the light guiding member 90, whereby a signal for detecting the volume of the toner can be distinguished from another signal for detecting the position of the agitator 39.

6. Operations and Effects

As hereinabove described, the detection light passing through the toner hopper 25 accommodating the toner is received by the light receiving element 103, and the volume of the toner accommodated in the toner hopper 25 and the position of the agitator 39 (agitating blade 83) are detected on the basis of the signal responsively output from the light receiving element 103. In other words, the position of the agitator 39 is detected through the light emitting element 102 and the light receiving element 103 provided for detecting the volume of the toner accommodated in the toner hopper 25. Therefore, no dedicated photodetection device is required for detecting the position of the agitator 39, and the position of the agitator 39 can be detected without increasing the number of the components.

When the position of the agitator 39 is detected, the stop position of the agitator 39 is controlled on the basis of the result of the detection. Thus, the agitator 39 can be stopped on a proper position.

According to the first embodiment, the toner hopper 25 is detachably mounted on the developer frame 30 of the developing section 24, and the opening/closing cover 38 is located on the closing position to close the hopper-side communication port 40 when the toner hopper 25 is detached from the developer frame 30. According to this structure, the toner can be prevented from leaking from the toner hopper 25 in the state where the toner hopper 25 is detached from the developer frame 30, while the agitating blade 83 of the agitator 39 may interfere with the opening/closing cover 38 moved from the opening position to the closing position, depending on the stop position of the agitator 39. This interference can be prevented by detecting the position of the agitator 39 and stopping the agitator 39 on a position where the interference between the agitating blade 83 and the opening/closing cover 38 can be avoided on the basis of the detected position.

In particular, the size of the agitating blade 83 in the direction of the radius of rotation is greater than the internal radius of the hopper frame 37, whereby the agitating blade 83 may easily interfere with the opening/closing cover 38 depending on the stop position of the agitator 39. However, this interference can be reliably prevented by stopping the agitator 39 on the position where the interference between the agitating blade 83 and the opening/closing cover 38 can be avoided when the hopper-side communication port 40 is closed with the opening/closing cover 38.

According to the first embodiment, the driving force is input in the agitator 39 and the developing roller 32 from the individual driving systems. Thus, only the agitator 39 can be rotated in the state where the developing roller 32 is stopped, in order to stop the agitator 39 on the proper position. Therefore, the developing roller 32 can be prevented from unnecessary driving, and from deteriorating.

Second Embodiment

The image forming apparatus according to the present invention can alternatively be formed as a laser printer having a main body casing 2 provided with a photosensitive drum 27 and a toner hopper 25 directly attached to/detached from the main body casing 2, for example.

Third Embodiment

The present invention is also applicable to a structure integrating a toner hopper 25 and a developing section 24 with each other.

Fourth Embodiment

The present invention is not restricted to the aforementioned monochromatic laser printer, but is also applicable to a color laser printer of various types (four-cycle type, intermediate-transfer tandem type, direct transfer tandem type etc.).

Fifth Embodiment

According to the aforementioned first embodiment, the light shielding plates 84 are provided with the light guiding member 90, and the light receiving element 103 receives the detection light passing through the light guiding member 90 and outputs the low-level signal when the light guiding member 90 is opposed to the light passing windows 65, so that the position of the agitating blade 83 can be detected. When the volume of the toner remaining in the toner hopper 25 is reduced, however, the light receiving element 103 receives the detection light immediately after the light shielding plates 84 pass the position opposed to the light passing windows 65, and outputs the low-level signal (empty signal), whereby the position of the agitating blade 83 can be detected also on the basis of this empty signal. In other words, the light receiving element 103 starts outputting the empty signal immediately after the light shielding plates 84 pass the position opposed to the light passing windows 65, whereby the position of the agitating blade 83 can be detected on the basis of the timing when the light receiving element 103 starts outputting the empty signal. The interference between the agitating blade 83 and the opening/closing cover 38 can be prevented by stopping the agitator 39 after a lapse of a prescribed time from the timing when the light receiving element 103 starts outputting the empty signal.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. An image forming apparatus comprising:

a first casing accommodating a developing agent and having a first opening;

an agitating member rotatably provided in the first casing for agitating the developing agent;

a detection device outputting a signal in response to receiving of detection light passing through the first casing; and a control unit detecting an amount of the developing agent accommodated in the first casing and a position of the agitating member on the basis of the signal output from the detection device.

2. The image forming apparatus according to claim 1, wherein the control unit comprises:

a detect section detecting the position of the agitating member, and a control section controlling a stop position of the agitating member on the basis of a result of detection by the detect section.

3. The image forming apparatus according to claim 1, wherein the first casing has a wall portion perpendicular to an axis of rotation of the agitating member, the wall portion has a first light passing portion allowing passage of the detection light, and the agitating member comprises:

a rotating shaft rotatably supported on the wall portion;

an agitating blade supported by the rotating shaft;

a light shielding member supported by the rotating shaft and provided on the upstream side in a rotational direction of the agitating member with respect to the agitating blade, for blocking the detection light; and a second light passing portion formed in the light shielding member for allowing passage of the detection light.

4. The image forming apparatus according to claim 2, comprising:

a second casing on which the first casing is detachably mounted, the second casing having a second opening opposed to the first opening;

a developing agent carrier rotatably provided in the second casing for carrying the developing agent supplied from the first casing; and a shutter member disposed between the first opening and the second opening.

5. The image forming apparatus according to claim 4, wherein a dimension of the agitating member in a direction of radius of rotation thereof is formed greater than a distance between an axis of rotation of the agitating member and the first opening.

6. The image forming apparatus according to claim 4, wherein the agitating member and the developing agent carrier are rotated by driving force input from individual driving systems.

7. A cartridge comprising:

a first casing having a wall portion and accommodating a developing agent;

a first light passing portion formed in the wall portion for allowing passage of detection light passing through the first casing; and an agitating member for agitating the developing agent accommodated in the first casing, wherein the agitating member comprises:

a rotating shaft rotatably supported on the wall portion;

an agitating blade supported by the rotating shaft;

a light shielding member supported by a rotating shaft; and a second light passing portion provided on the light shielding member for allowing passage of the detection light.

8. The cartridge according to claim 7, wherein the wall portion comprises:

a first wall supporting one end of the rotating shaft and a second wall opposed to the first wall and supporting the other end of the rotating shaft, and the first light passing portions are respectively provided on the first wall and the second wall to be opposed to each other.

9. The cartridge according to claim 8, wherein the second light passing portion is in the form of a cylinder extending along an axial direction of the rotating shaft.

10. The cartridge according to claim 9, wherein the second light passing portion has a dimension substantially equal to a dimension of the rotating shaft in the axial direction of the rotating shaft.

11. The cartridge according to claim 10, wherein the light shielding members are provided on the both ends of the rotating shaft and supporting the second light passing portion.

12. The cartridge according to claim 7, wherein the light shielding member is provided on different position with respect to the agitating blade in a rotational direction of the agitating member.

13. The cartridge according to claim 8, further comprising:

a cleaning member provided on a position different from positions of the agitating blade and the light shielding member in a rotational direction of the agitating member, and cleaning the first light passing portion.

14. The cartridge according to claim 7, wherein the first casing is provided with a first opening for discharging the developing agent, the cartridge comprises a shutter member opening/closing the first opening, and a dimension of the agitating member in a direction of radius of rotation thereof is formed greater than a distance between an axis of rotation of the agitating member and the first opening.

* * * * *